United States Patent [19]

Wickens

[11] Patent Number: 4,611,441

[45] Date of Patent: Sep. 16, 1986

[54] GEODESIC DOME

[76] Inventor: Thomas A. Wickens, 912 Alexandria Pike, Anderson, Ind. 46012

[21] Appl. No.: 715,713

[22] Filed: Mar. 25, 1985

[51] Int. Cl.[4] ..... E04B 1/32

[52] U.S. Cl. ..... 52/81; 52/582; 52/220

[58] Field of Search ..... 52/81, 309.11, 582, 52/220

[56] References Cited

U.S. PATENT DOCUMENTS

| | | | |
|---|---|---|---|
| 3,343,324 | 9/1967 | Gordon | 52/81 X |
| 3,660,952 | 5/1972 | Wilson | 52/81 |
| 3,858,372 | 1/1975 | Wilson | 52/81 |
| 3,998,023 | 12/1976 | Anderson | 52/595 |
| 3,998,024 | 12/1976 | Frandsen | 52/595 |
| 4,009,543 | 3/1977 | Smrt | 52/582 |
| 4,422,267 | 12/1983 | Whitehouse | 52/81 |

*Primary Examiner*—Carl D. Friedman

*Attorney, Agent, or Firm*—John H. Calhoun, Jr.

[57] ABSTRACT

An insulated geodesic dome comprising a plurality of closed triangular building construction panels of two kinds wherein the panels of the first kind are smaller than the panels of the second kind, and wherein each panel comprises a triangular frame having outside and inside covers adapted to cover the frame and to provide structural strength and rigidity to the frame. A plurality of spaced apart notches is provided along each edge of each cover. During assembly of a dome, edges of panels are butted together with notches of adjoining panels aligned opposite one another. Adjoining panels are assembled together using metal straps and screws placed in the notches. An angular recess is provided along the bottom outside edge of each frame so that a channel adapted to receive an electrical conductor cable placed therein is formed when any two panels are assembled together. Openings between adjoining panels are sealed against the entrance of moisture by a suitable means such by placing silicone caulk in the crevices between adjoining panels and covering the edges of adjoining panels with a pressure sensitive adhesive backed neoprene foam strip. Each panel is provided with a pair of vapor barriers to seal the inside of the panel against the entrance of moisture and, and each panel is filled with an insulating core comprising a corrugated cardboard grid filled with blown cellulose fiber insulation.

8 Claims, 6 Drawing Figures

GEODESIC DOME

BACKGROUND OF THE INVENTION

This invention relates to geodesic domes, and more particularly to insulated geodesic domes comprising a plurality of double-skinned, triangular-shaped, insulated building panels.

Geodesic domes are well known in the prior art as shown in U.S. Pat. No. 4,009,543 issued on Mar. 1, 1977 to Thomas J. Smrt. Geodesic domes are formed by assembling a plurality of triangular panels together to form a dome structure. Triangular panels employed to form a geodesic dome of any given size are of two types, one type being relatively smaller than the other type. The smaller panel comprises an isosceles triangle in which the two equal interior angles are approximately 54.63°, and the larger panel comprises an isosceles triangle in which the two equal interior angles are approximately 60.71°. The side of the smaller triangle that is common to the two equal angles of the smaller triangle is approximately equal in length to the side of a pentagon centered about the vertex of the third angle, and is also equal in length to the side of the larger triangle that is common to the two equal angles of the larger triangle. In the larger triangle the side common to the two equal angles is approximately equal in length to the side of hexagon centered about the vertex of the third angle of the larger triangle.

Double-skin building panels having insulated cores are also known in the prior art as shown in U.S. Pat. No. 3,998,023 issued on Dec. 21, 1976 to John W. Anderson and U.S. Pat. No. 3,998,024 issued on Dec. 21, 1976 to LeRoy Frandsen. However, the Anderson and Frandsen panels are not adapted to form a geodesic dome but are adapted to form a flat wall surface by assembling a plurality of panels in overlap relationship to one another.

SUMMARY OF THE INVENTION

The geodesic dome of the present invention has all the advantages of geodesic domes known in the prior art, and in addition it provides several distinct and important advantages not provided by existing domes.

One object of the present invention is to provide a geodesic dome comprising a plurality of insulated panels that can be quickly and easily assembled on site by individuals who have little or no special training in construction and using nothing more than readily available hand tools.

Another object of the present invention is to provide a geodesic dome comprising a plurality of insulated panels that can be produced from commonly available and low cost materials.

Another object of the present invention is to provide a geodesic dome comprising a plurality of panels that are well insulated and capable of being easily assembled into an energy efficient structure.

Another object of the present invention is to provide a geodesic dome comprising a plurality of panels that may be assembled using strong yet simple and low cost connection means.

Another object of the present invention is to provide a geodesic dome comprising a plurality of insulated panels that are adapted to receive standard electrical service cables readily, securely and safely mounted thereto.

Another object of the present invention is to provide a geodesic dome comprising a plurality of insulated panels that are adapted to prevent the entrance of moisture into the dome.

Another object of the present invention is to provide a geodesic dome comprising a plurality of insulated panels that are simple in construction, inexpensive, strong and durable, and well adapted for the purposes for which they are designed.

Other objects and advantages of the present invention will become apparent from a consideration of the following detailed description taken in connection with the accompanying drawings wherein a preferred embodiment of the invention is shown. It should be understood that the invention is not limited to the details disclosed, but includes all such variations and modifications as fall within the spirit of the invention and the scope of the appended claims.

The objectives of the present invention are accomplished by providing a plurality of insulated building panels of two types, wherein one type is relatively smaller than the other type. Each panel comprises three frame members joined together at their ends to produce an isosceles triangular frame. Each frame is provided with outer and inner covers adapted to enclose the frame. Each edge of each panel is adapted to abut with and be coupled to an edge of another panel. An angular recess is provided in the outside edge of the bottom of each frame member, and the inner cover of each panel extends only to the edges of the recesses. When any two panels are butted and joined together, the recesses in the adjoining panels combine to form a channel adapted to receive a standard electrical service cable mounted therein. The crevices between adjoining panels are sealed against the entrance of moisture by placing silicone caulk in the crevices and by covering the crevices with strips of pressure sensitive adhesive backed neoprene foam. Each panel is filled with an insulating core comprising an open ended corrugated cardboard grid filled with an insulating medium such, for example, as blown cellulose fiber insulation, and each panel is provided with a pair of vapor barriers to seal the interior of the panel against the entrance of moisture. A geodesic dome may be quickly and easily erected by properly assembling a plurality of larger and smaller triangular panels.

BRIEF DESCRIPTION OF THE DRAWINGS

A preferred embodiment of the present invention is illustrated in the accompanying drawings in which.

DESCRIPTION OF THE PREFERRED EMBODIMENT

Figure 3:
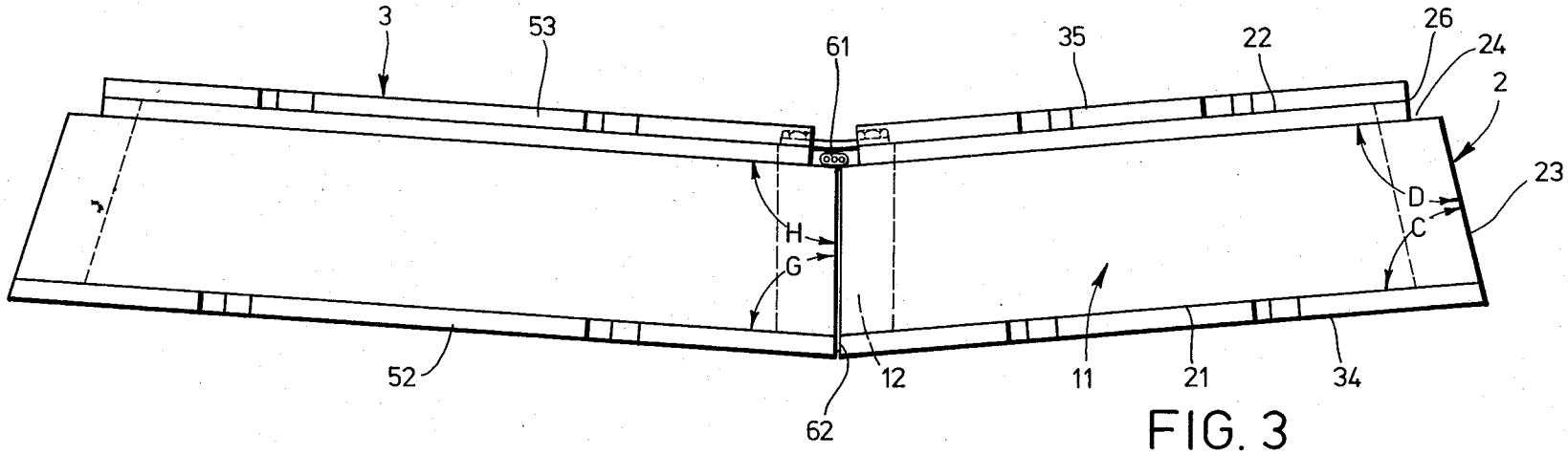
FIG. 3 is a side elevation view of a pair of panels of a dome of the present invention.
Figure 1:
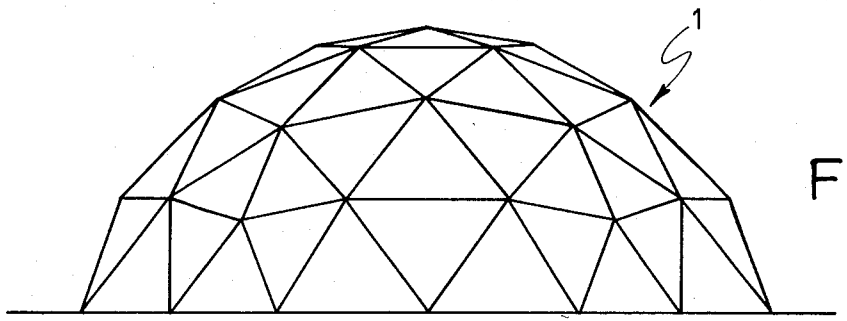
FIG. 1 is an front elevation view of a dome of the present invention.
Figure 2:
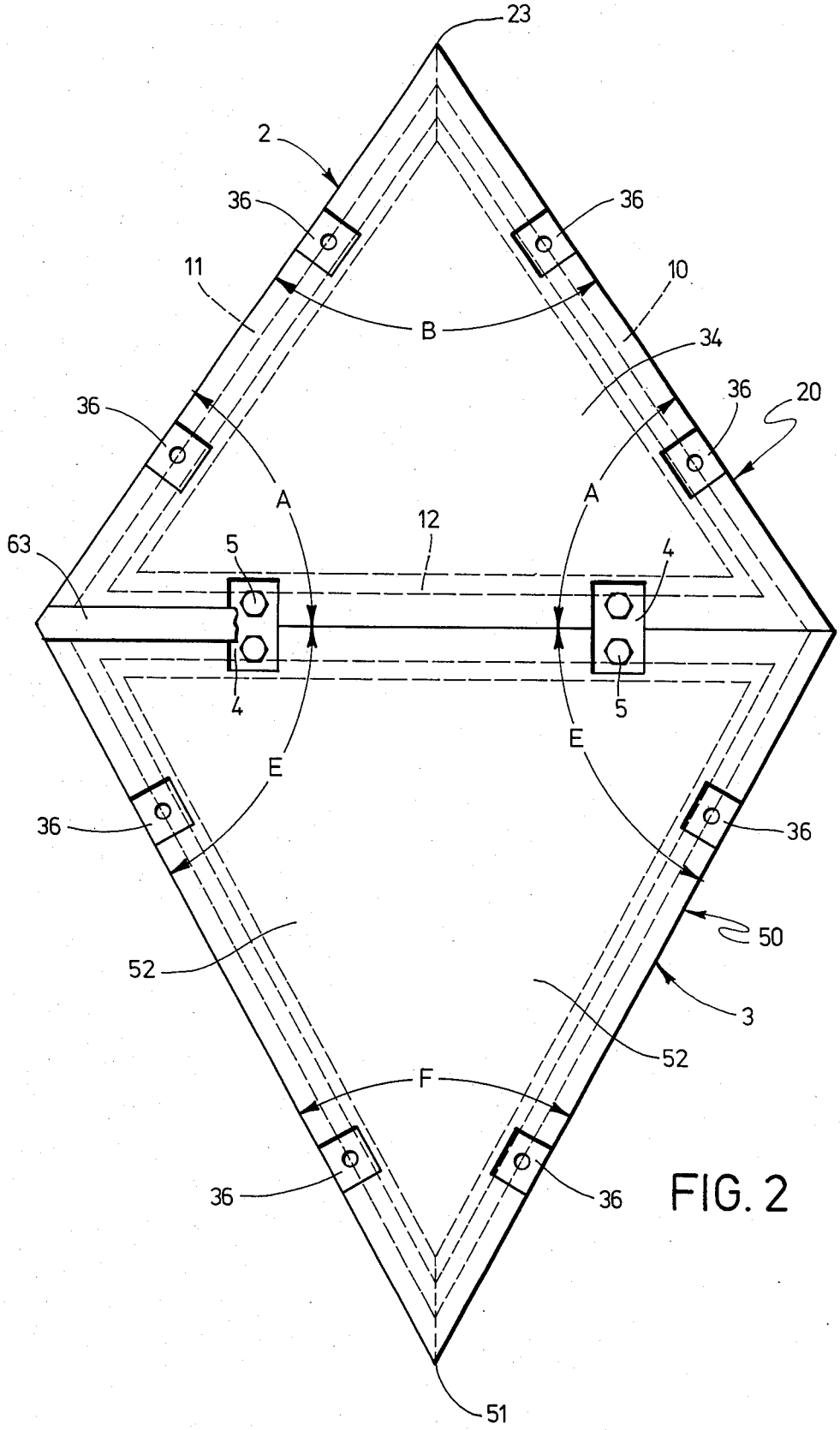
FIG. 2 is a top plan view of a pair of panels of a dome of the present invention.
Figure 4:
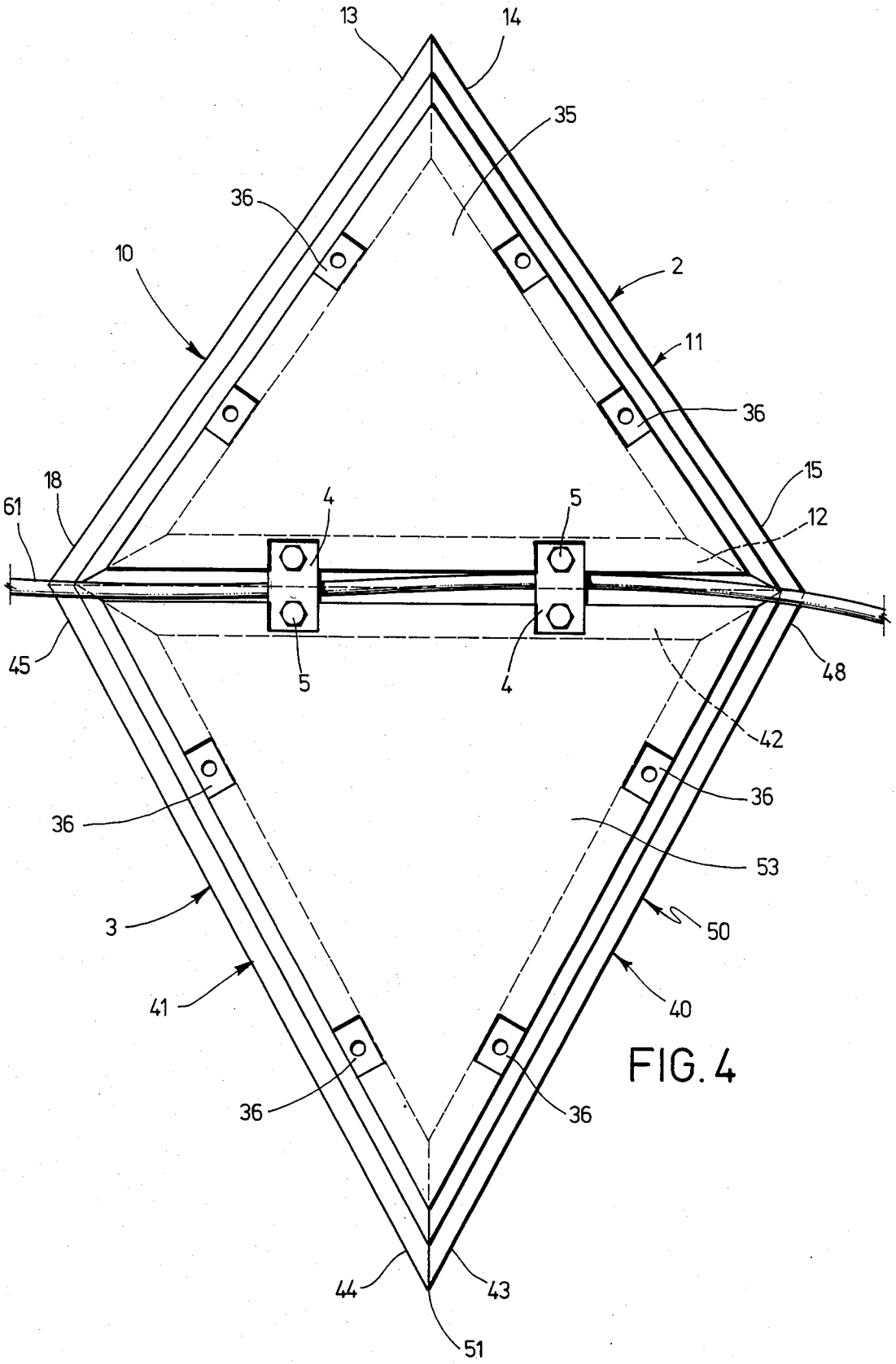
FIG. 4 is a bottom plan view of a pair of panels of a dome of the present invention.

Referring now to the drawings in greater detail, FIG. 1 illustrates the insulated geodesic dome of the present invention, shown generally at 1. as shown in FIGS. 2–4, the dome 1 comprises a plurality of smaller triangular panels 2 and a plurality of larger triangular panels 3, adapted to be assembled together using a plurality of connector means 4, 5.

Figure 5:
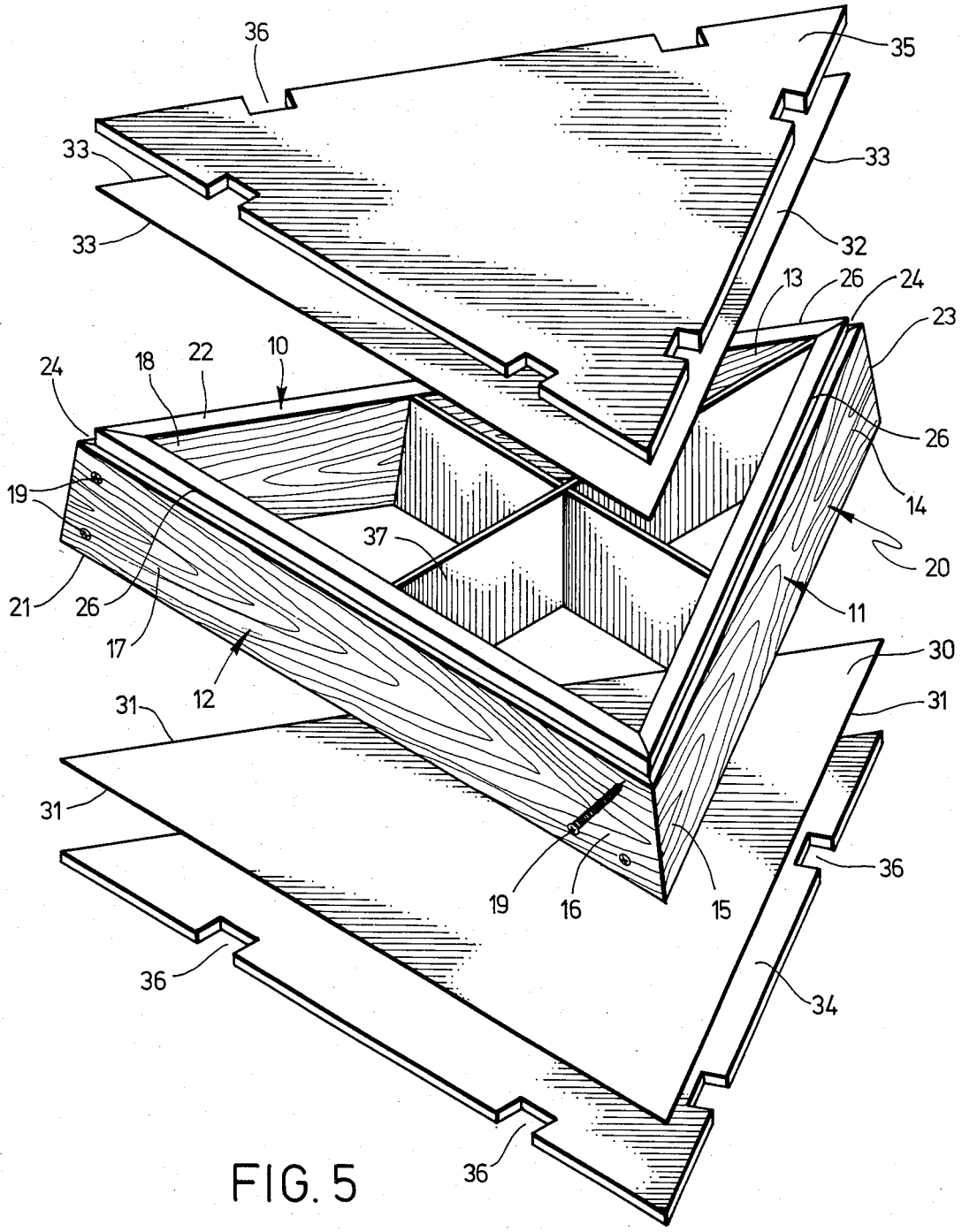
FIG. 5 is an exploded bottom view in perspective of a smaller panel of a dome of the present invention.

As shown in FIG. 5, a smaller panel 2 comprises three frame members 10, 11, 12 joined together at their ends 13, 14, 15, 16, 17, 18 by suitable fastening means 19 to form an isosceles triangular frame 20 having a top 21 and a bottom 22 wherein a first frame member 10 and a second frame member 11 are made equal in length to one another and wherein a third frame member 12 is made approximately equal in length to the length of a side of a pentagon centered about a vertex 23 formed at the juncture of the first and second frame members 10, 11. As shown in FIG. 2, a triangular frame 20 thus formed by frame members 10, 11, and 12 has two equal interior angles A of approximately 54.63° and an interior angle B of approximately 70.73°. Referring again to FIG. 5, the frame members 10, 11, and 12 are identical except for the length that is required to provide the desired angles. An angular recess 24 is provided along the outside edge of the bottom 22 of the frame 20, to form a corner 26.

Figure 6:
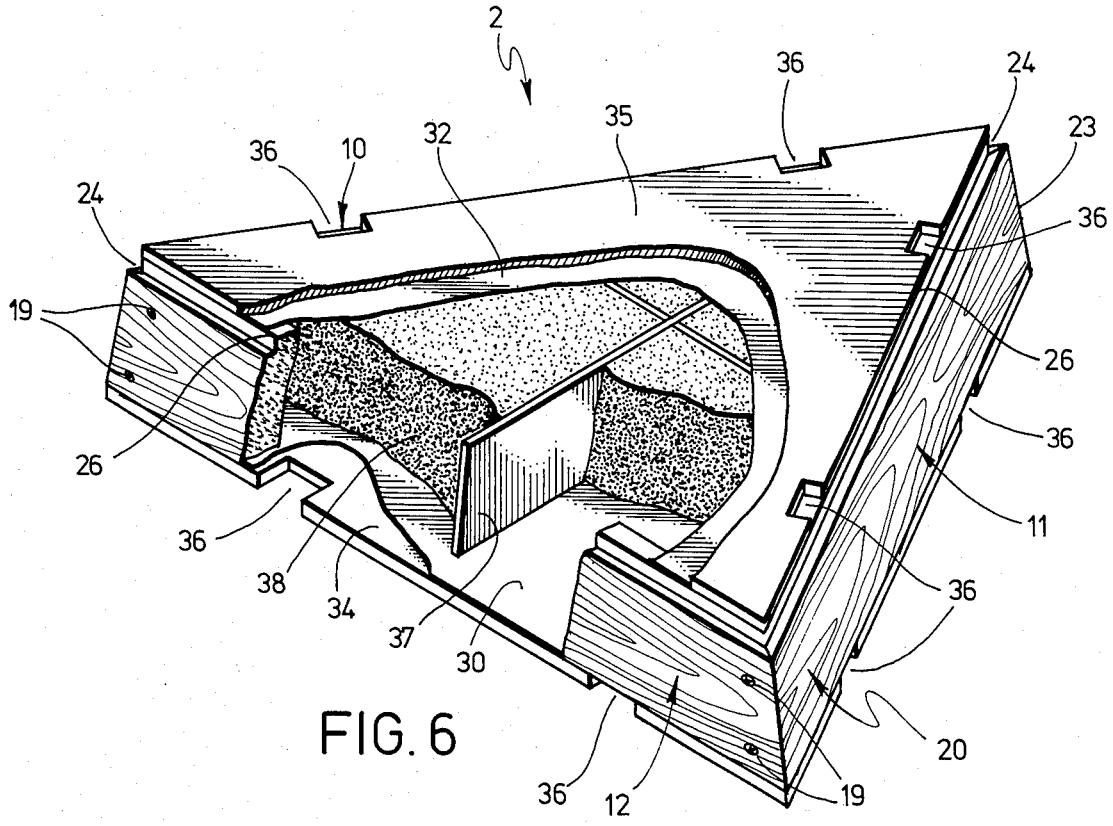
FIG. 6 is a cutaway bottom view in perspective of a smaller panel of a dome of the present invention.

A outer vapor barrier 30 comprising a moisture impervious metallic or plastic sheet is placed over the top 21 of the frame 20 and sealed at its edges 31 to the said top 21 of the said frame 20. A inner vapor barrier 32 is placed over the bottom 22 of the frame 20 and is sealed at its edges 33 to the said bottom 22 of the said frame 20. The frame 20 is also provided with outer and inner covers 34, 35 adapted to cover the outside and the inside of the frame 20. The outer cover 34 is laterally offset from and spaced apart from the inner cover 35, and each cover 34, 35 is provided with a plurality of spaced apart notches 36, each adapted to receive a bonding strap 4 and and a plurality of screws 5 placed therein. The inner cover 35 extends to the corners 26 formed by the recesses 24. The covers 34, 35 are parallel with each other and as shown in FIG. 3, each frame member 10, 11, 12 abuts against the outer cover 34 to form an interior angle C of approximately 79.96°, and against the inner cover 35 to form an interior D angle of approximately 100.04°. As shown in FIG. 6, the panel 2 is filled with an insulating core comprising an open-ended corrugated cardboard grid 37 filled with an insulating medium 38 such, for example, as blown cellulose fiber.

As shown in FIGS. 2 and 4, the larger panel 3 comprises three frame members 40, 41, 42 joined together at their ends by suitable fastening means to form a larger isosceles triangular frame 50. The first frame member 40 and second frame member 41 are made equal in length to one another and the third frame member 42 is made approximately equal in length to the length of a side of a hexagon centered about a vertex 51 formed at the juncture of the first and second frame members 40, 41 and also equal in length to the aforesaid third frame member 12 of the aforesaid smaller panel 2. As shown in FIG. 2, the triangular frame 50 thus formed by frame members 40, 41, and 42 has two equal interior angles E of approximately 60.71° and an interior angle F of approximately 58.58°. Frame members 40, 41, 42 are identical to frame members 10, 11, and 12 except for the lengths that are required to provide the desired angles. The frame 50 is provided with an angular recess 24 along its outside bottom edge.

The larger panel 3 is identical in construction to the smaller panel 2 except for the lengths of the frame members and the magnitudes of the various angles. Vapor barriers and an insulating core like those in the smaller panel 2 are provided in the larger panel 3. The frame 50 of the larger panel 3 is provided with outer and inner covers 52, 53 adapted to cover the outside and the inside of the frame 50. The outer cover 52 is laterally offset from and spaced apart from the inner cover 53, and each cover 52, 53 is provided with a plurality of spaced apart notches 36 each adapted to receive a bonding strap 4 and a plurality of screws 5 placed therein. The covers 52, 53 are parallel with each other and as shown in FIG. 3, each frame members 40, 41, 42 abuts against the outer cover 52 to form an interior angle G of approximately 78.10° and against the inner cover 53 to form an interior angle H of approximately 101.90°.

The angles A, B, C, D, E, F, G. and H of the smaller and larger panels 2, 3 remain constant as the sizes of panels are varied to provide domes of varying sizes, only the lengths of frame members 10, 11, 12, 40, 41, 42 changing. Frame member 12 of the smaller panel 2 and frame member 42 of the larger panel 3 are always equal in length.

An insulated geodesic dome 1 is formed by assembling a plurality of panels 2, 3 together as shown in FIGS. 1–4. The edges of panels 2, 3 are butted together with notches 36 of adjoining panels aligned with one another. Panels 2, 3 are bonded together at their top and bottom edges using bonding straps 4 and screws 5. When any two panels 2, 3 are assembled together, the recesses 24 of the adjoining panels combine to form a channel 60 adapted to receive one or more electrical service cables 61 mounted therein. FIGS. 3 and 4 show a three-wire cable 61, of the kind commonly used for providing electrical service to residential buildings mounted within a channel 60 formed by a smaller panel 2 and a larger panel 3.

As shown in FIGS. 2 and 3, the spaces between adjoining panels are sealed against the entrance of moisture by suitable sealing means such, for example, as a silicone caulk 62 inserted in the crevices between adjoining panels and a pressure sensitive adhesive backed neoprene foam strip 63 placed over the edges of the panels.

Having thus described my invention, what I now claim is:

1. An insulated geodesic dome comprising a plurality of closed triangular building construction panels wherein each panel comprises a triangular frame formed by three frame members joined at their ends to form three apices, each frame having provided on the outside bottom edge thereof an angular recess adapted to combine with a like angular recess of an adjoining panel to form a channel adapted to receive an electrical service cable placed therein, and wherein each panel is provided with an outer cover having provided therein a plurality of notches adapted to be aligned in abutting relationship with a plurality of like notches in an outer cover of an adjoining panel, said notches being adapted to receive panel connector means placed therein and an inner cover having provided therein a plurality of notches adapted to be aligned in abutting relationship with a plurality of like notches in an inner cover of an adjoining panel and adapted to receive panel connector means placed therein, and wherein each panel is provided with a thermal insulating core disposed within the said triangular frame and between the said outer cover and the said inner cover, and wherein each panel is provided with a pair of vapor barriers adapted to seal the inside of the panel against the entrance of moisture;

a plurality of panel connector means each means comprising a connector strap adapted to be inserted into a pair of opposing notches in the outer covers or a pair of opposing notches in the inner covers of two adjoining panels and adapted to be fastened by suitable fastening means to the two adjoining panels; a plurality of fastening means adapted to fasten the aforesaid connector means to pairs of adjoining panels; and a sealing means adapted to seal the interfaces between pairs of adjoining panels against the entrance of moisture into an insulated geodesic dome constructed of a plurality of said panels.

2. An insulated geodesic dome comprising a plurality of closed triangular building construction panels wherein each panel comprises a triangular frame formed by three frame members joined at their ends to form three apices, each frame member having provided on the outside bottom edge thereof an angular recess adapted to combine with a like angular recess of an adjoining panel to form a channel adapted to receive an electrical service cable placed therein, and wherein each panel is provided with an outer cover adapted to cover the said triangular frame and having provided therein a plurality of notches adapted to be aligned in abutting relationship with a plurality of like notches in an outer cover of an adjoining panel and adapted to receive panel connector means placed therein, an inner cover laterally offset from and spaced apart from the outer cover and adapted to cover the said triangular frame and having provided therein a plurality of notches adapted to be aligned in abutting relationship with a plurality of like notches in an inner cover of an adjoining panel and adapted to receive panel connector means placed therein; an insulating core comprising an open grid disposed within the said triangular frame and between the said outer cover and the said inner cover, the said grid being filled with an insulating medium; a first vapor barrier placed over and sealed to the top surface of the said triangular frame and a second vapor barrier placed over and sealed to the bottom surface of the said triangular frame, wherein the said first and second vapor barriers are adapted to seal the said inside of the panel against the entrance of moisture; a plurality of panel connector means each means comprising a connector strap adapted to be inserted into a pair of opposing notches in the outer covers or a pair of opposing notches in the inner covers of two adjoining panels and adapted to be fastened by suitable fastening means to abutting frame members of two adjoining panels; a plurality of fastening means adapted to fasten the aforesaid connector means to the said abutting frame members of pairs of adjoining panels; and sealing means adapted to seal the interfaces between pairs of abutting panels against the entrance of moisture into an insulated geodesic dome constructed of a plurality of said panels, said sealing means comprising caulking inserted into the crevices between adjoining panels and pressure sensitive and adhesive backed closed cell neoprene tape extending across the boundaries between adjoining panels.

3. An insulated geodesic dome comprising a plurality of closed triangular building construction panels of a first kind and a plurality of closed triangular building construction panels of a second kind wherein the panels of the first kind are smaller than the panels of the second kind and wherein each panel comprises a triangular frame formed by three frame members joined at their ends to form three apices, each frame having provided on the outside bottom edge thereof an angular recess adapted to combine with a like angular recess of an adjoining panel to form a channel adapted to receive an electrical service cable placed therein, and wherein each panel is provided with an outer cover having provided therein a plurality of notches adapted to be aligned in abutting relationship with a plurality of like notches in an outer cover of an adjoining panel, said notches being adapted to receive panel connector means placed therein and an inner cover having provided therein a plurality of notches adapted to be aligned in abutting relationship with a plurality of like notches in an inner cover of an adjoining panel and adapted to receive panel connector means placed therein, and wherein each panel is provided with a thermal insulating core disposed within the said triangular frame and between the said outer cover and the said inner cover, and wherein each panel is provided with a pair of vapor barriers adapted to seal the inside of the panel against the entrance of moisture; a plurality of panel connector means each means comprising a connector strap adapted to be inserted into a pair of opposing notches in the outer covers or a pair of opposing notches in the inner covers of two adjoining panels and adapted to be fastened by suitable fastening means to the two adjoining panels; a plurality of fastening means adapted to fasten the aforesaid connector means to pairs of adjoining panels; and a sealing means adapted to seal the interfaces between pairs of adjoining panels against the entrance of moisture into an insulated geodesic dome constructed of a plurality of said panels.

4. An insulated geodesic dome comprising a plurality of closed triangular building construction panels of a first kind and a plurality of closed triangular building construction panels of a second kind wherein the panels of the first kind are smaller than the panels of the second kind and wherein each panel comprises a triangular frame formed by three frame members joined at their ends to form three apices, each frame member having provided on the outside bottom edge thereof an angular recess adapted to combine with a like angular recess of an adjoining panel to form a channel adapted to receive an electrical service cable placed therein, and wherein each panel is provided with an outer cover adapted to cover the said triangular frame and having provided therein a plurality of notches adapted to be aligned in abutting relationship with a plurality of like notches in an outer cover of an adjoining panel and adapted to receive panel connector means placed therein, an inner cover laterally offset from and spaced apart from the outer cover and adapted to cover the said triangular frame and having provided therein a plurality of notches adapted to be aligned in abutting relationship with a plurality of like notches in an inner cover of an adjoining panel and adapted to receive panel connector means placed therein; an insulating core comprising an open grid disposed within the said triangular frame and between the said outer cover and the said inner cover, the said grid being filled with an insulating medium; a first vapor barrier placed over and sealed to the top surface of the said triangular frame and a second vapor barrier placed over and sealed to the bottom surface of the said triangular frame, wherein the said first and second vapor barriers are adapted to seal the said inside of the panel against the entrance of moisture; a plurality of panel connector means each means comprising a connector strap adapted to be inserted into a pair of opposing notches in the outer covers or a pair of opposing notches in the inner covers of two adjoining panels and adapted to be fastened by suitable fastening means to abutting frame members of two adjoining panels; a plurality of fastening means adapted to fasten the aforesaid connector means to the said abutting frame members of pairs of adjoining panels; and sealing means adapted to seal the interfaces between pairs of abutting panels against the entrance of moisture into an insulated geodesic dome constructed of a plurality of said panels, said sealing means comprising caulking inserted into the crevices between adjoining panels and pressure sensitive and adhesive backed closed cell neoprene tape extending across the boundaries between adjoining panels.

5. An insulated geodesic dome comprising a plurality of closed triangular building construction panels wherein each panel comprises a triangular frame formed by three frame members joined at their ends to form three apices, each frame having provided on the outside bottom edge thereof an angular recess adapted to combine with a like angular recess of an adjoining panel to form a channel adapted to receive an electrical service cable placed therein, and wherein each panel is provided with an outer cover having provided therein a plurality of notches adapted to be aligned in abutting relationship with a plurality of like notches in an outer cover of an adjoining panel, said notches being adapted to receive panel connector means placed therein and an inner cover having provided therein a plurality of notches adapted to be aligned in abutting relationship with a plurality of like notches in an inner cover of an adjoining panel and adapted to receive panel connector means placed therein, and wherein each panel is provided with a thermal insulating core disposed within the said triangular frame and between the said outer cover and the said inner cover, and wherein each panel is provided with an internal vapor barrier; a plurality of panel connector means each means comprising a connector strap adapted to be inserted into a pair of opposing notches in the outer covers or a pair of opposing notches in the inner covers of two adjoining panels and adapted to be fastened by suitable fastening means to the two adjoining panels; a plurality of fastening means adapted to fasten the aforesaid connector means to pairs of adjoining panels; and a sealing means adapted to seal the interfaces between pairs of adjoining panels against the entrance of moisture into an insulated geodesic dome constructed of a plurality of said panels.

6. An insulated geodesic dome comprising a plurality of closed triangular building construction panels of a first kind and a plurality of closed triangular building construction panels of a second kind wherein the panels of the first kind are smaller than the panels of the second kind and wherein each panel comprises a triangular frame formed by three frame members joined at their ends to form three apices, each frame having provided on the outside bottom edge thereof an angular recess adapted to combine with a like angular recess of an adjoining panel to form a channel adapted to receive an electrical service cable placed therein, and wherein each panel is provided with an outer cover having provided therein a plurality of notches adapted to be aligned in abutting relationship with a plurality of like notches in an outer cover of an adjoining panel, said notches being adapted to receive panel connector means placed therein and an inner cover having provided therein a plurality of notches adapted to be aligned in abutting relationship with a plurality of like notches in an inner cover of an adjoining panel and adapted to receive panel connector means placed therein, and wherein each panel is provided with a thermal insulating core disposed within the said triangular frame and between the said outer cover and the said inner cover, and wherein each panel is provided with an internal vapor barrier; a plurality of panel connector means each means comprising a connector strap adapted to be inserted into a pair of opposing notches in the outer covers or a pair of opposing notches in the inner covers of two adjoining panels and adapted to be fastened by suitable fastening means to the two adjoining panels; a plurality of fastening means adapted to fasten the aforesaid connector means to pairs of adjoining panels; and a sealing means adapted to seal the interfaces between pairs of adjoining panels against the entrance of moisture into an insulated geodesic dome constructed of a plurality of said panels.

7. An insulated geodesic dome comprising a plurality of closed triangular building construction panels wherein each panel comprises a triangular frame formed by three frame members joined at their ends to form three apices, each frame having provided on the outside bottom edge thereof an angular recess adapted to combine with a like angular recess of an adjoining panel to form a channel adapted to receive an electrical service cable placed therein, and wherein each panel is provided with an outer cover having provided therein a plurality of notches adapted to be aligned in abutting relationship with a plurality of like notches in an outer cover of an adjoining panel, said notches being adapted to receive panel connector means placed therein and an inner cover having provided therein a plurality of notches adapted to be aligned in abutting relationship with a plurality of like notches in an inner cover of an adjoining panel and adapted to receive panel connector means placed therein; a plurality of panel connector means each means comprising a connector strap adapted to be inserted into a pair of opposing notches in the outer covers or a pair of opposing notches in the inner covers of two adjoining panels and adapted to be fastened by suitable fastening means to the two adjoining panels; a plurality of fastening means adapted to fasten the aforesaid connector means to pairs of adjoining panels; and a sealing means adapted to seal the interfaces between pairs of adjoining panels against the entrance of moisture into an insulated geodesic dome constructed of a plurality of said panels.

8. An insulated geodesic dome comprising a plurality of closed triangular building construction panels of a first kind and a plurality of closed triangular building construction panels of a second kind wherein the panels of the first kind are smaller than the panels of the second kind and wherein each panel comprises a triangular frame formed by three frame members joined at their ends to form three apices, each frame having provided on the outside bottom edge thereof an angular recess adapted to combine with a like angular recess of an adjoining panel to form a channel adapted to receive an electrical service cable placed therein, and wherein each panel is provided with an outer cover having provided therein a plurality of notches adapted to be aligned in abutting relationship with a plurality of like notches in an outer cover of an adjoining panel, said notches being adapted to receive panel connector means placed therein and an inner cover having provided therein a plurality of notches adapted to be aligned in abutting relationship with a plurality of like notches in an inner cover of an adjoining panel and adapted to receive panel connector means placed therein; a plurality of panel connector means each means comprising a connector strap adapted to be inserted into a pair of opposing notches in the outer covers or a pair of opposing notches in the inner covers of two adjoining panels and adapted to be fastened by suitable fastening means to the two adjoining panels; a plurality of fastening means adapted to fasten the aforesaid connector means to pairs of adjoining panels; and a sealing means adapted to seal the interfaces between pairs of adjoining panels against the entrance of moisture into an insulated geodesic dome constructed of a plurality of said panels.

* * * * *